US008727230B2

(12) United States Patent
Bednarczyk et al.

(10) Patent No.: US 8,727,230 B2
(45) Date of Patent: May 20, 2014

(54) SYSTEM FOR FASTENING A RAIL TO A SLEEPER

(75) Inventors: Adrian Bednarczyk, Lüdenscheid (DE); Nikolaj Krieg, Hagen (DE); Serdar Gözsüz, Herscheid (DE)

(73) Assignee: Vossloh-Werke GmbH, Werdohl (DE)

( * ) Notice: Subject to any disclaimer, the term of this patent is extended or adjusted under 35 U.S.C. 154(b) by 85 days.

(21) Appl. No.: 13/183,659

(22) Filed: Jul. 15, 2011

(65) Prior Publication Data

US 2013/0015256 A1 Jan. 17, 2013

(51) Int. Cl.
*E01B 9/00* (2006.01)

(52) U.S. Cl.
USPC ..... 238/349; 238/315

(58) Field of Classification Search
USPC ..... 238/338, 349, 351, 264, 265, 269, 282, 238/287, 297, 306, 310
See application file for complete search history.

(56) References Cited

U.S. PATENT DOCUMENTS

| | | | | |
|---|---|---|---|---|
| 4,967,954 | A * | 11/1990 | von Lange | 238/310 |
| 5,865,370 | A * | 2/1999 | Sonneville et al. | 238/331 |
| 6,257,495 | B1 * | 7/2001 | Eisenberg | 238/349 |
| 7,080,791 | B2 * | 7/2006 | Geissele et al. | 238/264 |
| 7,648,080 | B2 * | 1/2010 | Hohne et al. | 238/351 |
| 7,992,796 | B2 * | 8/2011 | Bednarczyk | 238/264 |
| 8,181,887 | B2 * | 5/2012 | Seifert et al. | 238/310 |
| 2003/0085294 | A1 * | 5/2003 | Rada | 238/265 |
| 2004/0232254 | A1 * | 11/2004 | Kowalski | 238/264 |
| 2008/0257972 | A1 * | 10/2008 | Vorderbruck et al. | 238/331 |
| 2013/0015256 | A1 * | 1/2013 | Bednarczyk et al. | 238/315 |

FOREIGN PATENT DOCUMENTS

DE 202010015286 U1 6/2011

* cited by examiner

*Primary Examiner* — Jason C Smith
(74) *Attorney, Agent, or Firm* — The Webb Law Firm

(57) ABSTRACT

The invention relates to a system for fastening a rail to a sleeper with a baseplate, which includes at least one side portion and a bearing surface adjoining the side portion for the rail to be fastened, and with at least one guide plate that sits on the side portion. In order to simplify the installation on the respective sleeper in such a system, the invention provides that the guide plate is held on the baseplate by a catch connection formed in the region of the side portion.

22 Claims, 4 Drawing Sheets

SYSTEM FOR FASTENING A RAIL TO A SLEEPER

The present invention relates to a system for fastening a rail to a sleeper. In this connection such a system includes a base plate comprising at least one side portion and a bearing surface adjacent to the side portion for the rail to be fastened, and at least one guide plate that sits on the side portion.

A system of this type is known for example from German utility model specification DE 20 2010 015 286 U1. The known system includes in each case two guide plates, one of which is in each case arranged on a side portion of the base plate. The guide plates are in this connection formed as so-called angle guide plates and comprise a guide section which rests on the shoulder portion of the guide plate associated with the guide plate, as well as a guide section that abuts on the edge of the guide plate and in the finally installed system engages downwardly in a groove formed in the respective sleeper. At the same time the respective shoulder portion of the guide plates in the finally installed system is supported on a shoulder formed on the sleeper, so that the guide plate is supported on the sleeper also in a direction aligned transverse to the longitudinal length, and the transverse forces occurring when the rail fastening point formed by a system according to the invention is driven over are transmitted directly to the sleeper.

The guide plates of the known system comprise in each case a through opening for a clamping screw running from its free upper side to its lower side associated with the base plate, which serve to tension a spring element placed on the respective guide plate. The clamping screws are for this purpose screwed into a peg embedded in the sleeper. In order to permit this, two through openings are formed in the base plate, one of which in each case when guide plates are placed on the base plate is flush with the opening of the respective guide plates.

In the installation of the known system the base plate is first of all arranged on the respective sleeper and then in each case one of the guide plates is placed with its guide section on the side portion of the base plate with which it is associated. The positioning of the base plate and guide plates must in this connection be performed so exactly with respect to one another that on the one hand the guide plates abut with their shoulder portion on the shoulder of the sleeper associated in each case with them, and on the other hand the openings of the base plate and guide plates are aligned flush with respect to one another. In the known system outlined here the alignment of the base plate and guide plates is additionally complicated by the fact that before the base plate is placed on the sleeper a layer of adhesive is applied, which compensates unevennesses of the sleeper and bonds the base plate to the sleeper.

Against the background of the prior art outlined above the object of the invention consisted in providing a system of the afore described type in which the installation on the respective sleeper is simplified.

This object is achieved according to the invention by a system with the features specified in claim 1.

Advantageous modifications of the invention are disclosed in the dependent claims and, like the general inventive concept, are described in detail hereinafter.

A system according to the invention for fastening a rail to a sleeper comprises in conformity with the prior art mentioned in the introduction a base plate that comprises at least one side portion and a bearing surface adjacent to the said side portion for the rail to be fastened, and at least one guide plate that sits on the side portion.

According to the invention the guide plate is now held on the base plate by means of a catch connection formed in the region of the side portion. The catch connection provided according to the invention between the base plate and the guide plate enables the guide plate and the base plate to be joined to one another to form a structural unit before the actual installation of the system at the respect construction site takes place. Thus, the preassembly of guide plate and base plate can be carried out for example already in the production facility that produces the individual parts of a system according to the invention. The structural unit formed from the at least one guide plate and the base plate can then be placed in a simple manner on the appropriately prepared sleeper at the construction site.

Regardless of whether the guide plate and the base plate are installed separately from one another or are installed as a preassembled structural unit at the construction site, the positive engagement connection between the guide plate and the base plate formed by means of a catch connection according to the invention ensures that the guide plate and the base plate are properly aligned with respect to one another at the installation site, without having to take particular care in the positioning of the guide plate and the base plate. As a result of the locking engagement of the guide plate and base plate it is now only necessary to position the base plate in the proper way on the solid sleeper. A complicated alignment of the guide plate in relation to the base plate is no longer necessary, as is the need to check the correct position of the guide plate before the installation of the further structural elements of a system according to the invention.

With the invention a system for fastening a rail to a sleeper is thus made available, which is characterised by a particularly simple mode of installation. The possibility of the preassembly of a system according to the invention already at the production facility thus reduces to a minimum the work stages to be carried out at the construction site.

In order to produce the catch connection provided according to the invention, in each case catch elements in the form of elastic catch arms provided with suitable catches can be formed on the base plate and the guide plate, so that the catch elements of the guide plate and base plate lockingly engage with one another when the guide plate sits on the base plate.

If however only very minor changes have to be made to the guide plate so that it is suitable for a system according to the invention, then this can be accomplished by forming a catch element only on the base plate, which cooperates with a correspondingly formed stop means present on the guide plate. The advantage of this arrangement is that on the one hand only shaped elements projecting on the base plate, namely the at least one catch arm lockingly engaging in each case with the guide plate, have to be provided for the catch connection, whereas on the guide plate simply a suitable stop surface has to be made available, with which the relevant catch element of the base plate cooperates. This enables the bearing surface of the base plate associated with the sleeper to be formed without regard to the catch connection with the guide plate, so that an optimally simple positioning and installation on the respective sleeper is possible. Furthermore, catch projections on the guide plate that engage in corresponding recesses of the base plate and would at the same time project beyond their lower side in the direction of the respective sleeper can be avoided in this way.

In the case where the catch element is formed on the base plate, in principle any shoulder or any surface section of the guide plate that can be reached by the catch element of the base plate is suitable as stop means for the catch element. A particularly practical modification of the invention is obtained if the guide plate comprises an opening leading from its free upper side to its lower side abutting the base plate and the catch connection is formed in the region of the opening of the guide plate. Due to the arrangement in the opening the catch connection is protected in a particularly simple manner against external damage. In particular the risk that the catch connection could be unintentionally released on impact with an external object is minimised.

With respect to the producibility of the base plate provided in a system according to the invention, it has proved convenient if a recess formed in the base plate is associated with the catch element, which recess laterally adjoins a side surface of the catch element. On the one hand due to the recess the elasticity in the region of the connection of the catch element to the base plate is increased so that the catch element in use has an optimum elasticity for the catch connection. This effect occurs not only if the base plates are made of a plastic material, but also if they consist of sheet metal. Furthermore, with base plates produced from a plastic material the material volume saved in the region of the recess is made available for the forming of the respective catch element.

In this connection, in the case where an opening is provided on the guide plate, the positive engagement catch connection provided according to the invention between the guide plate and the base plate can be produced if the catch element is formed as a catch arm that engages through the opening of the guide plate and has at its free end a catch projection that cooperates in a positive engagement manner with the associated stop means formed on the guide plate. An edge region of the upper side of the guide plate delimiting the opening at least in sections can for example serve as stop means for the catch projection. This has the additional advantage that the free end of the catch arm serving as catch element can be reached without any problem if the connection between the guide plate and the base plate is to be subsequently released to replace the guide plate for example.

The locking engagement of the guide plate and base plate in an arrangement of the locking engagement in an opening can be optimized if at least two catch arms are provided that jointly engage through the opening of the guide plate.

As explained in the introduction, with many known rail fastening systems the guide plates are in each case provided with a central opening through which a clamping element in the form of a screw, stud-bolt or nail is guided when the system is finally installed. The clamping element then directly or indirectly tensions a spring element supported on the guide plate against the respective sleeper, which Bxerts on the foot of the rail the force required to hold down the rail to be fastened with the system according to the invention.

If also in a system according to the invention the guide plate is provided with an opening required for this purpose, then this opening can be used for the catch connection formed in the manner described hereinbefore. In the case where the clamping element is to be joined directly to the respective sleeper, an opening corresponding to the opening of the guide plate has to be provided in the base plate, so that during installation the clamping element can be guided through the opening of the guide plate and the associated opening of the base plate to the sleeper. In order in this case to be able to use a conventional clamping element available on the market, for example a screw, a stud-bolt or a nail, the clear diameter of the opening of the guide plate can be matched to the external diameter of the clamping element so that the clamping element can be displaced with sufficient play through the opening also when the clamping arm engages in the opening. Since the relevant clamping element is normally not supported directly on the guide plate, but acts directly only on the spring element sitting on the guide plate, the catch elements engaging through the opening of the guide plate do not interfere with the function of the clamping element also in this embodiment of the invention.

In particular in combination with a recess formed laterally of the catch element, the opening delimited laterally at least in sections by the respective catch element has proved particularly advantageous, since then a particularly high elasticity of the catch element joined to the base plate in this case only via webs acting in the manner of torsion springs can be ensured.

The guide plate can be produced in a manner known per se from a plastic material.

In a likewise known manner the base plate can be formed from a steel material.

A system according to the invention has proved to be particularly practical if the base plate comprises two side portions arranged opposite one another, which between them define the bearing surface. A guide plate can then sit respectively on each of the side portions, the guide plate being held in each case on the base plate by a catch connection. In this way a complete structural unit is made available that is simple to install and at the same time creates the precondition for all further structural parts required for the fastening of the respective rail to find the optimum position for their particular function without any problem.

In order in addition to assist the latter, with the at least one guide plate of a system according to the invention shaped elements such as projections and cavities can likewise be formed in a manner known per se on the free upper side to guide a spring element that can be supported on the guide plate.

In this connection the locking engagement of the guide plate and base plate according to the invention is particularly suitable for these systems in which the guide plate is formed as an angle guide plate with a guide section resting on the side portion of the base plate associated with the guide plate, and a guide section that abuts on the associated side of the base plate.

If a rail fastening system according to the invention is to have a defined elasticity in a direction aligned perpendicular to the upper side of the base plate, then this can be ensured in a known manner by providing an elastic layer that lies on the bearing surface of the base plate. In order also to simplify its installation as much as possible, the elastic layer can be held on the base plate by means of the guide plate lockingly engaged with the base plate. This can be accomplished by arranging the elastic layer and the guide plate so that they overlap at least in sections, so that the guide plate lockingly engaged with the base plate holds the elastic layer by positive engagement on the base plate.

The invention is described in more detail hereinafter with the help of an exemplary embodiment and with reference to the accompanying drawings, in which.

Figure 1:
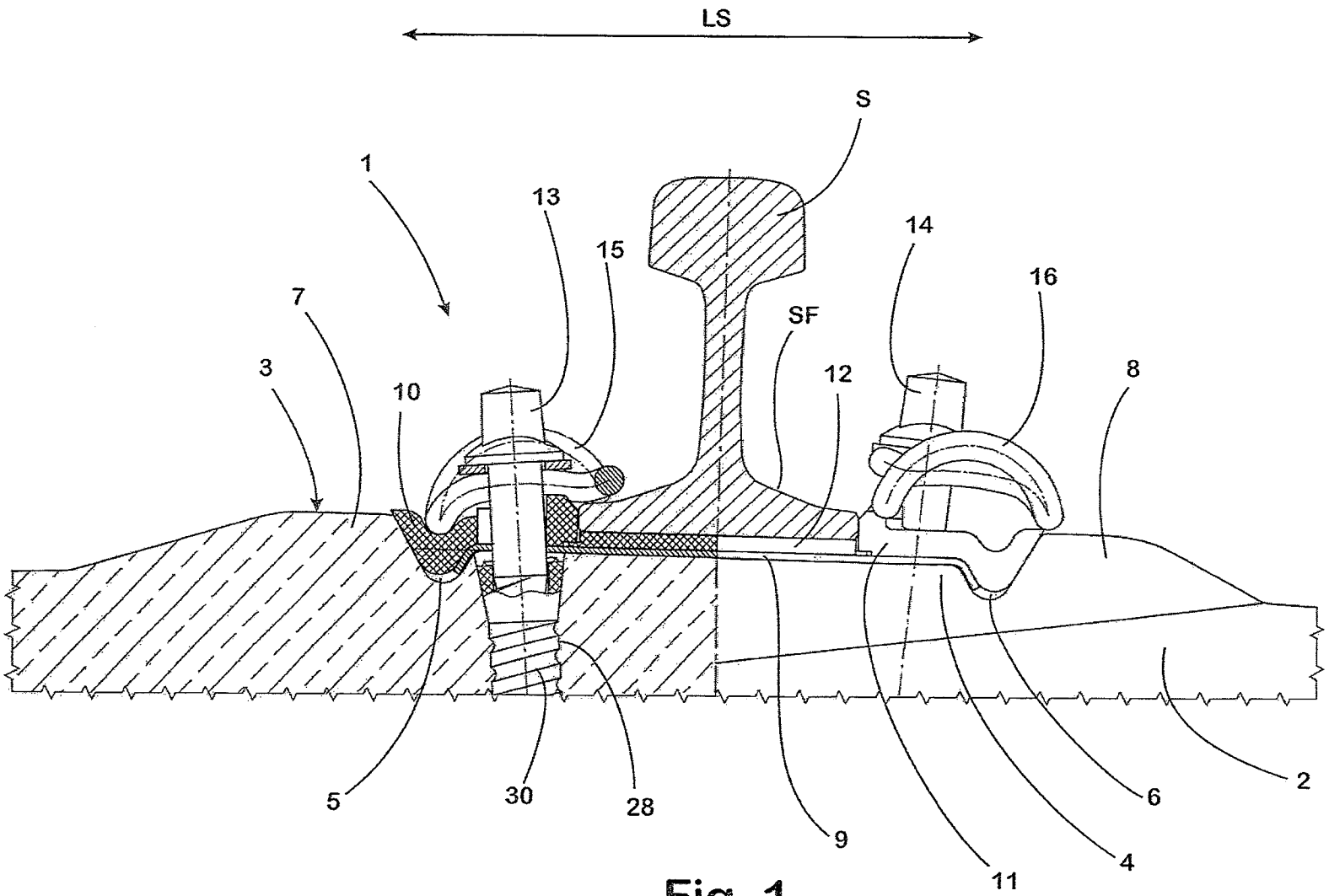
FIG. 1 shows a fastening point formed using a system according to the invention for a rail in a partial sectional view in the longitudinal direction of the sleeper, in which the finally installed position of the system is shown cut-away on the left-hand side, while the preassembly position can be seen on the right-hand side.
Figure 2:
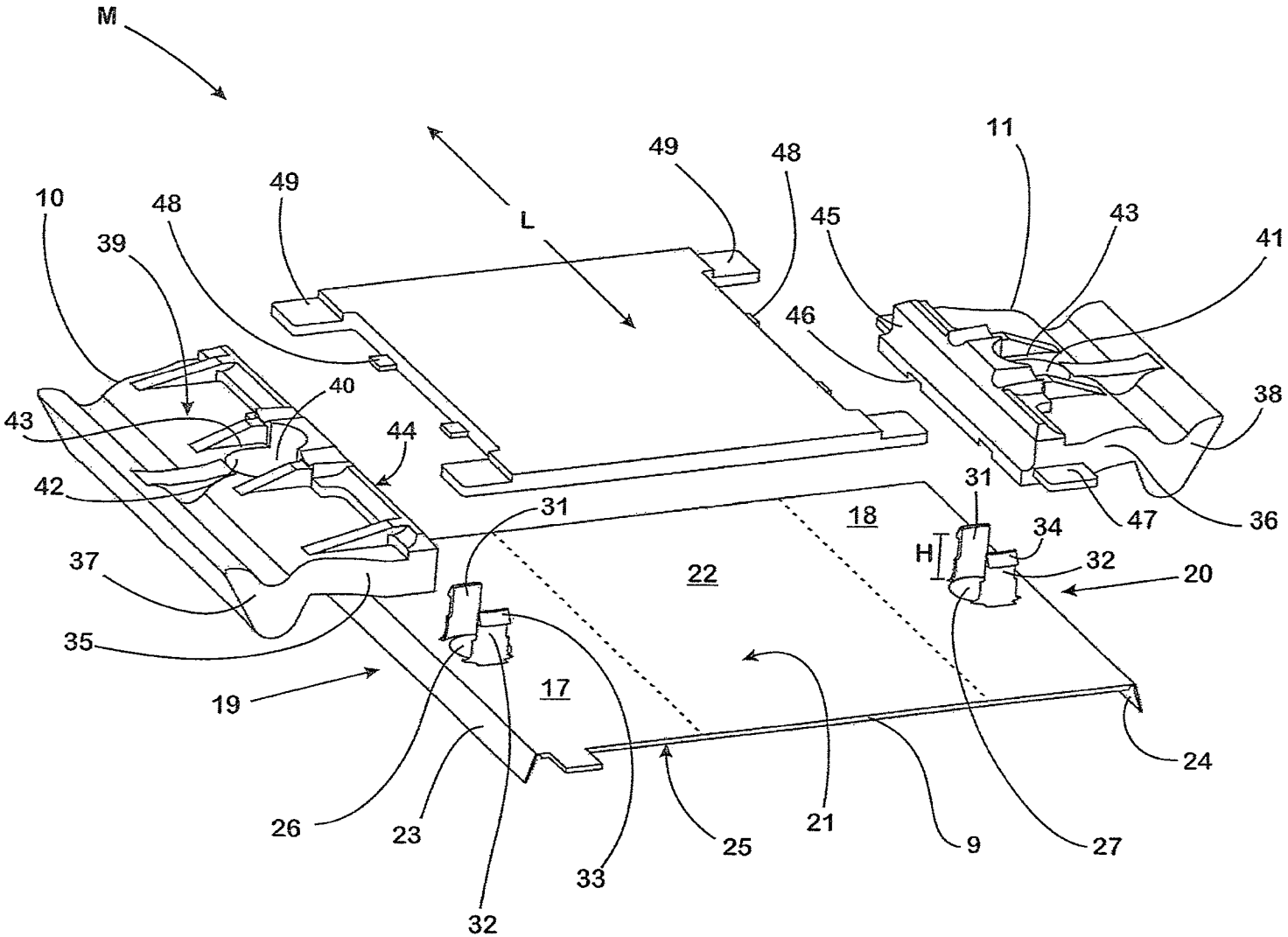
FIG. 2 shows in an exploded view parts of the system for fastening a rail.
Figure 3:
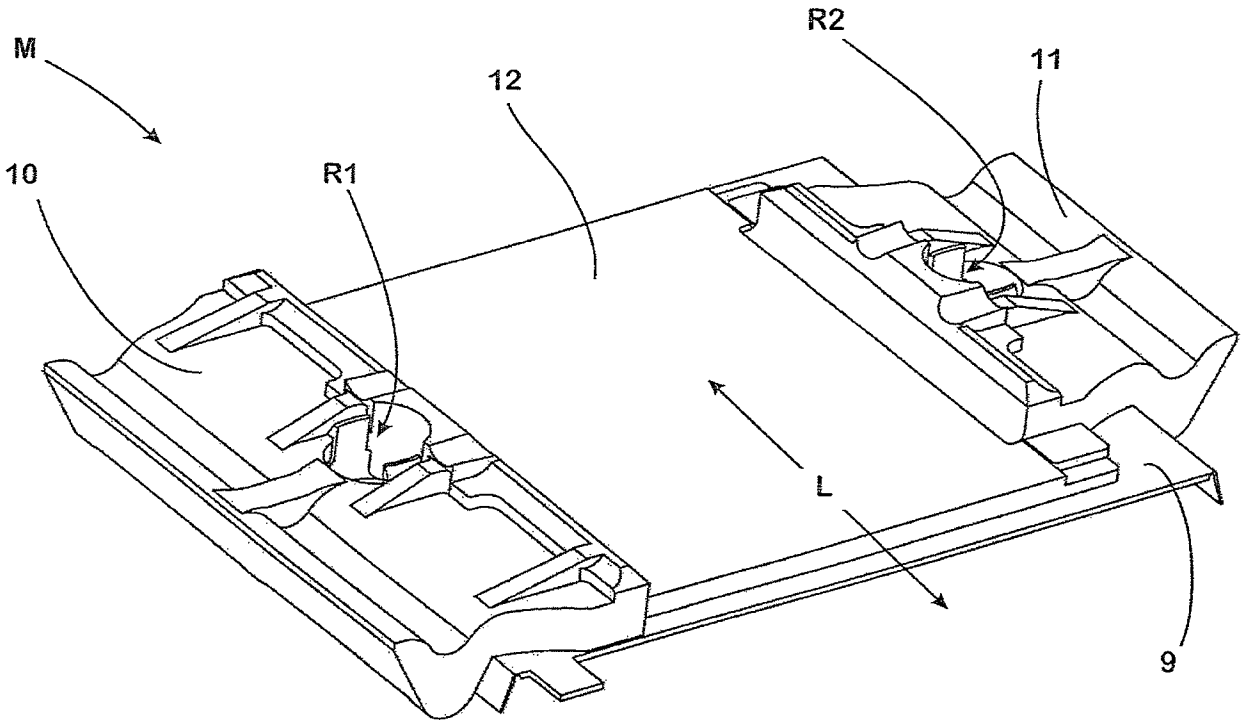
FIG. 3 shows a structural unit preassembled from the parts illustrated in FIG. 2.
Figure 4:
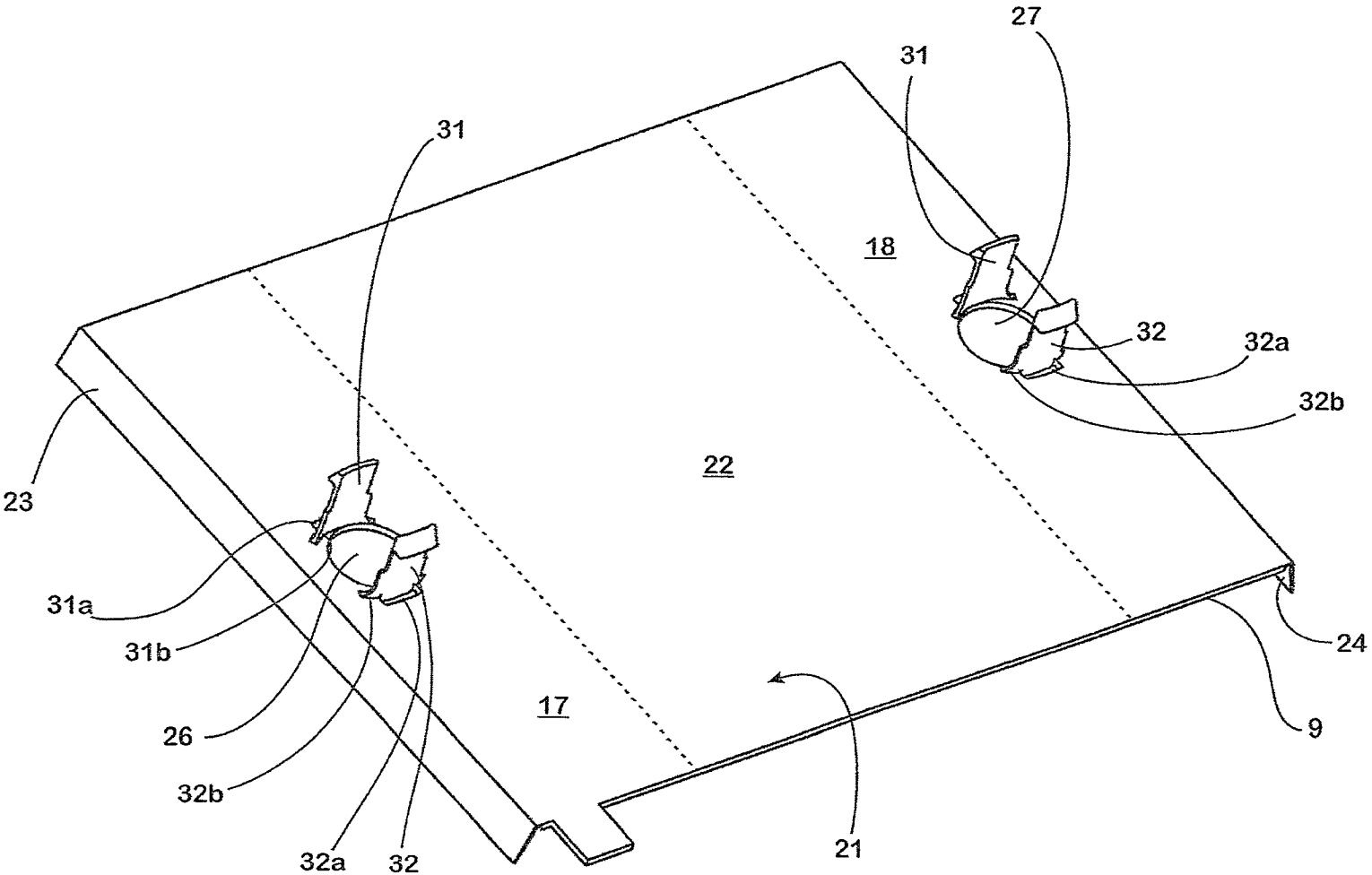
FIG. 4 shows a base plate used in the system according to FIGS. 1 to 3.

The fastening point 1 shown in FIG. 1 comprises a sleeper 2 made of concrete, on the upper side 3 of which is formed a bearing section 4. The bearing section 4 is aligned centrally with respect to the length LS of the sleeper 2 measured transverse to the longitudinal direction L of the rail S to be fastened, and has a length that is greater than the width of the foot of the rail SF measured in the direction of the length LS. At the same time the bearing section 4, which is right-angled in plan view, extends over the whole width of the sleeper 2 measured in the longitudinal direction L of the rail S. On its narrow sides the bearing section 4 is in each case delimited by a groove-shaped cavity 5, 6 of V-shaped cross-section, which likewise extends in each case over the width of the sleeper 2 and on its side facing away from the bearing section 4 transforms in each case into a shoulder 7, 8 formed on the sleeper 2.

The rail S is fastened to the sleeper 2 by means of a system comprising a base plate 9 lying on the bearing section 4 of the sleeper 2, two guide plates 10, 11, an elastic layer 12 lying on the base plate 9, two clamping elements 13, 14 formed as conventional clamping screws, as well as two spring elements 15, 16 formed in the manner of likewise conventional, W-shaped rail clips.

The base plate 9 produced for example from a sufficiently stable plastic material has a rectangular shape adapted to the shape of the bearing section 4, with two side portions 17, 18, one of which in each case adjoins one of the narrow sides 19, 20 of the base plate 9 and which between them define a bearing surface 22 on the free upper side 21 of the base plate 9.

A transverse edge section 23, 24 is formed in each case on the narrow sides 19, 20 of the base plate 9. The transverse edge sections 23, 24 are in each case tilted towards the lower side 25 of the base plate 9. The angle enclosed between the transverse edge sections 23, 24 and the undeformed, flat side portions 17, 18 is in this connection adapted to the angle at which the sides of the cavities 5, 6 adjoining the bearing section 4 are aligned in relation to the free upper side 3 of the bearing section 4. At the same time the interspacing of the transverse edge sections 23, 24 is dimensioned so that the transverse edge sections 23, 24 in the installed position lying on the bearing section 4 engage respectively in one of the cavities 5, 6. In, this way the base plate 9 in its installed position is located in a positive engagement manner on the bearing section 4 in the longitudinal direction LS of the sleeper 2.

A through opening 26, 27 is formed respectively in the side portions 17, 18 of the base plate 9. The through openings 26, 27 are in this connection arranged in each case in such a way that in the installed position they are aligned flush to in each case one of the cavities 28 formed in the manner of a countersunk hole in the sleeper 2, in which in each case sits a plastic peg 30. At the same time the diameter of the through openings 26, 27 is dimensioned so that the clamping elements 13, 14 with their threaded section can be displaced freely with sufficient play through said openings.

A pair of catch elements 31, 32 is formed in each case on the base plate 9 adjacent to the openings 26, 27. The catch elements 31, 32 are formed as catch arms, whose free ends have in each case at a height H above the flat upper side 21 of the base plate 9 a laterally aligned catch projection 33, 34 facing away from the associated opening 26, 27. Also, the mutual interspacing of the catch elements 31, 32 is dimensioned so that the clamping elements 13, 14 with their threaded section can in each case be displaced freely with sufficient play through the space delimited laterally by the catch elements 31, 32.

On the side of the catch elements 31, 32 facing away from the respective circular opening 26, 27 there is formed in each case an additional recess 31*a*, 32*a*, which is formed as a slit-shaped through opening and laterally directly adjoins the respective catch element 31, 32. In this way the catch elements 31, 32 are in each case connected only by a narrow, web-shaped section 31*b*, 32*b* to the remaining body of the base plate 9 formed as a whole in one part.

The guide plate 10 is a heavy duty plate designed for particularly high stresses, while the guide plate 11 is of lighter construction. The guide plates 10, 11 satisfy the features that are of interest here however, and therefore hereinafter no distinction will be made between them.

The guide plates 10, 11 likewise consisting of plastic material are formed in the manner of conventional angle guide plates and have in each case a guide section 35, 36 resting on the side portion 17, 18 of the base plate 9 associated with the respective guide plate 10, 11, and a shoulder portion 37, 38, which in the case of the guide plate 10, 11 arranged on the base plate 9 abuts on the in each case associated transverse edge section 23, 24 of the respective narrow side 19, 20 of the base plate 9.

In the guide section 35, 36 of the guide plates 10, 11 there is formed in each case a through opening 40, 41 leading from the free upper side 39 of the respective guide plate 35, 36 to its lower side associated with the base plate 9. Its position is adapted to the position of the through opening 26, 27 of the side section 17, 19 of the base plate 9 associated with the respective guide plate 10, 11, so that the through openings 40, 41 are aligned flush to the through opening 26, 27 associated therewith when the guide plates 10, 11 are mounted on the base plate 9. The diameter of the through openings 40, 41 of the guide plates 10, 11 is in this connection dimensioned so that when the guide plates 10, 11 sit on the base plate 9 the catch elements 31, 32 abut tightly against the inner circumferential surface 42 of the through openings 40, 41 delimiting the said through openings 40,41. At the same time the height Hat which the catch projections 33, 34 are arranged above the upper side 21 of the guide plate 9 is dimensioned so that the catch projections 33, 34 rest on the edge region 43 of the free upper side 39 of the guide plates 10, 11 delimiting the respective through opening 40, 41, when the guide plates 10, 11 sit on the base plate 9. The edge region 43 correspondingly forms a stop means for the catch elements 31, 32, so that a catch connection R1, R2 is formed for each guide plate 10, 11 when the guide plates 10, 11 are mounted on the base plate 9, by means of which the guide plates 10, 11 are held reliably and securely in each case by positive engagement on the base plate 9.

On their front side associated with the rail S the guide section 35, 36 of the guide plates 10, 11 comprise in each case a bearing surface 44, 45, on which the foot SF of the rail S is laterally guided when the fastening point 1 is finally installed. On their lower edge, where they transform to the lower side of the guide plate 10, 11, two recesses 46 arranged spaced apart from one another are in each case formed in the bearing surface 44, 45, the recesses being open to the lower side of the guide plate 10, 11. In addition the light guide plate 11 comprises in each case on its short side a projection 47 protruding laterally from the guide section 36 in the form of an extension of the bearing surface 45, which is arranged at a defined distance from the lower side of the guide plate 11.

The elastic layer 12 lying in the installed position on the base plate 9 consists of an elastic material having a defined elasticity and permits a correspondingly defined elastic sinking of the rail S when a railway vehicle (not shown here) travels over it. The shape of the elastic layer 12 corresponds in this connection to the shape of the bearing surface 22 of the base plate 9 and is dimensioned so that the layer 12 completely covers the bearing surface 22 as far as a narrow edge region. In this connection tongue-like projections 48, 49 are formed in each case on the narrow sides of the elastic layer 12 associated with the guide plates 10, 11, whose position and shape are adapted to the recesses 46 and the projections 47 of the guide plates 10, 11 so that when the elastic layer 12 is lying on the base plate 9 and the guide plates 10, 11 are lockingly engaged with the base plate 9, the projections 48, 49 are clamped by positive engagement in the recesses 46 and under the projections 47 of the guide plate 11. In this way the elastic layer 12 is also held reliably and securely on the base plate 9.

The shoulder section 37, 38 adjoining the guide section 35, 36 of the respective guide plate 10, 11 is formed in a known manner having a v-shaped cross-section, so that in the installed position it sits on the one hand in positive engagement in the cavity 5, 6 of the sleeper 2 associated in each case with it, and on the other hand is supported on the associated shoulder 7, 8 of the sleeper 2 by its side facing away from the respective bearing surface 44, 45.

The spring elements 15, 16 provided for applying the necessary holding-down forces are formed as conventional W-shaped rail clips, as are normally used in fastening systems of the type discussed here. The spring elements 15, 16 correspondingly have a U-shaped middle section, on which acts in the finally installed state of the fastening point 1 the in each case associated clamping element 13, 14 with its screw head. The brackets of the middle section of the spring elements 15, 16 transform in each case into a holding aim, with which the spring element 15, 16 in the installed position presses in a resilient elastic manner on the side of the foot of the rail SF associated with it in each case.

A structural unit E is preassembled in the manufacturer's facility from in each case a base plate 9 and the guide plates 10, 11 lockingly engaged with it, and also from the elastic layer 12 held by the guide plates 10, 11 on the base plate 9. Such a structural unit E is placed on the bearing section 4 of the sleeper 2 for the installation of the fastening point 1. Due to its downwardly tilted transverse edge sections 23, 24 the base plate 9 is thereby automatically aligned so that its through openings 2 6, 27 are aligned flush with the plastic pegs 30 sitting in the sleeper 2. The spring elements 15' 16 are then, as illustrated in the righthand half of FIG. 1, placed in a manner known per se in a preassembly position on the associated guide plate 10, 11, in which their spring arms do no yet reach into the region defined between the guide plates 10, 11 and are tensioned by means of the clamping elements 13, 14 screwed into in each case one of the pegs 30 so that they automatically maintain their preassembly position, but can however still be displaced in the longitudinal direction LS of the sleeper 2.

After this the rail S is placed on the elastic layer 12 so that it is supported by the elastic layer 12 on the bearing surface 22 of the base plate 9.

The spring elements 15, 16 are now displaced in the direction of the rail S to their end position shown in the left-hand half of FIG. 1, in which their spring arms in each case press on the foot of the rail SF, and the clamping elements 13, 14 are tightened until the spring elements 15, 16 exert the required holding-down force on the rail.

LIST OF REFERENCE NUMERALS

1 Fastening point
2 Sleeper
3 Upper side of the sleeper
4 Bearing section
5, 6 Cavity of the sleeper 2
9 Base plate
7, 8 Shoulders of the sleeper 2
10, 11 Guide plates
12 Elastic layer
13, 14 Clamping elements
15,16 Spring elements
17, 18 Side portions of the base plate 9
19, 20 Narrow sides of the base plate 9
21 Upper side of the base plate 9
22 Bearing surface of the base plate 9
23,24 Transverse edge sections of the base plate 9
25 Lower side of the base plate 9
26, 27 Through opening of the base plate 9
28 Countersunk openings of the sleeper 2
30 Plastic peg
31, 32 Catch elements of the base plate 9
31*a*, 32*a* Recesses
31*b*, 32*b* Joining sections
33, 34 Catch projections
35, 36 Guide section of the guide plates 10, 11
37, 38 Shoulder section of the guide plates 10, 11
39 Upper side of the guide plates 35, 36
40, 41 Through opening of the guide plates 10, 11
42 Internal circumferential surface of the through openings 40, 41
43 The edge region delimiting the opening 40, 41
44, 45 Bearing surface of the guide plates 10, 11
46 Recesses of the guide plates 10, 11
47 Projections of the guide plate 11
48, 49 Projections of the elastic layer 12
E Structural unit
H Height of the catch projections 33, 34 above the flat upper side 21 of the base plate 9
L Longitudinal direction of the rail S to be fastened
LS Length of the sleeper 2
R1, R2 Catch connections
S Rail
SF Foot of the rail S

The invention claimed is:

1. A system for fastening a rail to a sleeper, the system comprising:

a base plate configured to lie on a bearing section of the sleeper, wherein the base plate comprises at least one side portion and a bearing surface adjoining the side portion for the rail to be fastened; and at least one guide plate that sits on the side portion of the base plate, wherein the guide plate is held on the base plate by a catch connection formed in the region of the side portion, whereby there is a locking engagement of the base plate and the guide plate.

2. The system according to claim 1, wherein at least one catch element is formed on the base plate, which cooperates with a correspondingly formed stop present on the guide plate.

3. The system according to claim 1, wherein a recess formed in the base plate is associated with the catch element, which recess laterally adjoins a side surface of the catch element.

4. The system according to claim 3, wherein the catch element is formed as a catch arm that engages through the opening of the guide plate and has at its free end a catch projection that cooperates in a positive engagement manner with the associated stop formed on the guide plate.

5. The system according to claim 3, wherein a stop for the catch projection is formed by an edge region of an upper side of the guide plate delimiting the opening at least in sections.

6. The system according to claim 3, wherein at least two catch arms are provided that engage jointly through the opening of the guide plate.

7. The system according to claim 1, wherein the guide plate has an opening leading from its free upper side to its lower side resting on the base plate, and that the catch connection between the base plate and the guide plate is formed in the region of the opening of the guide plate.

8. The system according to claim 1, wherein an opening formed in the base plate is associated with the opening of the guide plate.

9. The system according to claim 8, wherein the catch element with a side surface associated with the opening of the base plate adjoins the opening of the base plate.

10. The system according to claim 8, wherein it comprises a clamping element formed as a screw, stud-bolt or nail that is intended to be guided through the opening of the guide plate, and that the clear diameter of the opening of the guide plate is adapted to the external diameter of the clamping element in such a manner that the clamping element can be displaced with play through the opening when the catch element engages in the opening.

11. The system according to claim 1, wherein the guide plate is produced from a plastic material.

12. The system according to claim 1, wherein the base plate is formed from a plastic material or a steel material.

13. The system according to claim 1, wherein the base plate comprises two side portions arranged opposite one another that between them define the bearing surface.

14. The system according to claim 13, wherein a guide plate sits in each case on each of the side portions and each of the guide plates is held on the base plate by a catch connection.

15. The system according to claim 1, wherein shaped elements for guiding a spring element that can be supported on the guide plate are formed on the free upper side of the guide plate.

16. The system according to claim 1, wherein the guide plate is formed as an angle guide plate with a guide section resting on the side section of the base plate associated with the guide plate and a shoulder section that abuts on the associated side of the base plate.

17. The system according to claim 1, wherein it additionally comprises an elastic layer that lies on the bearing surface of the base plate.

18. The system according to claim 17, wherein the elastic layer is held on the base plate by the guide plate lockingly engaged with the base plate.

19. The system according to claim 17, wherein the elastic layer and the guide plate are arranged overlapping at least in sections.

20. The system according to claim 19, wherein the guide plate has at least one recess in which a projection of the elastic layer engages.

21. The system according to claim 1, wherein the base plate has a rectangular shape adapted to the shape of the bearing section of the sleeper.

22. The system according to claim 1, wherein the base plate has a uniform thickness throughout the base plate.

* * * * *